US009044086B1

(12) United States Patent
Johnston

(10) Patent No.: US 9,044,086 B1
(45) Date of Patent: Jun. 2, 2015

(54) MODULAR STORAGE RACK SYSTEM

(71) Applicant: Thomas J. Johnston, Mechanicsville, MD (US)

(72) Inventor: Thomas J. Johnston, Mechanicsville, MD (US)

( * ) Notice: Subject to any disclaimer, the term of this patent is extended or adjusted under 35 U.S.C. 154(b) by 0 days.

(21) Appl. No.: 14/222,940

(22) Filed: Mar. 24, 2014

Related U.S. Application Data

(60) Provisional application No. 61/804,466, filed on Mar. 22, 2013.

(51) Int. Cl.
*A47B 63/02* (2006.01)
*A47B 47/00* (2006.01)

(52) U.S. Cl.
CPC ..... *A47B 63/02* (2013.01); *A47B 47/0041* (2013.01); *A47B 47/00* (2013.01)

(58) Field of Classification Search
CPC ..... A47F 5/13; A47F 5/01; A47F 5/14; A47B 47/00; A47B 47/027; A47B 47/0041; A47B 45/00; F16B 7/00
USPC ..... 211/184, 182, 41.13, 41.14, 41.2, 191, 211/41.12, 41.1, 45, 189; 108/64, 94, 101, 108/180, 183, 185, 153.1
See application file for complete search history.

(56) References Cited

U.S. PATENT DOCUMENTS

| | | | | | |
|---|---|---|---|---|---|
| 256,600 | A | * | 4/1882 | Schell | 108/94 |
| 534,116 | A | * | 2/1895 | Lyons | 211/184 |
| 1,863,625 | A | * | 6/1932 | Fenstermaker | 108/61 |
| 2,368,740 | A | | 2/1945 | Blomgren | |
| 3,082,712 | A | * | 3/1963 | Johnson et al. | 108/158.11 |
| 3,234,896 | A | * | 2/1966 | Bonsall | 108/60 |
| 3,237,779 | A | * | 3/1966 | Eger | 211/191 |
| 3,337,061 | A | * | 8/1967 | Caudell | 211/134 |
| 3,523,613 | A | * | 8/1970 | Konstant | 211/191 |
| 3,530,997 | A | * | 9/1970 | Djorup | 211/184 |
| 3,606,023 | A | | 9/1971 | Edmunds | |
| 3,647,080 | A | * | 3/1972 | Denny | 211/191 |
| 3,757,967 | A | * | 9/1973 | Colbridge | 414/286 |
| 3,858,529 | A | * | 1/1975 | Salladay | 108/103 |
| 3,998,334 | A | * | 12/1976 | Smith | 211/45 |
| 4,033,459 | A | * | 7/1977 | Zach | 211/20 |
| 4,108,514 | A | * | 8/1978 | Zimmerman | 312/107 |
| D256,640 | S | * | 9/1980 | Farwell et al. | D7/701 |
| 4,245,746 | A | | 1/1981 | Aylor | |
| D260,063 | S | * | 8/1981 | Aylor | D6/407 |
| D267,373 | S | * | 12/1982 | Behrens | D6/411 |
| D271,453 | S | * | 11/1983 | Tucker | D6/462 |
| 4,423,849 | A | | 1/1984 | Jordan | |
| 4,697,713 | A | | 10/1987 | Pryor | |
| 4,714,027 | A | * | 12/1987 | Stern | 108/60 |
| 4,836,391 | A | | 6/1989 | Bell | |
| 4,993,548 | A | * | 2/1991 | Peterson | 206/315.1 |
| D321,608 | S | * | 11/1991 | Hay | D6/407 |

(Continued)

*Primary Examiner* — Joshua J Michener
*Assistant Examiner* — Devin Barnett
(74) *Attorney, Agent, or Firm* — Mattingly & Malur, PC

(57) ABSTRACT

A storage rack unit includes a pair of spaced planar end plates, an intermediate stabilizer panel and a plurality of dowels which extend between the two end plates. Each of the end plates has spaced dowel end receiving holes, each of whose longitudinal axes are angled with respect to a line perpendicular to the plane of each end plate. The angles of the holes in the first end plate are different from the angles of the holes in the second end plate. The provision of these angled holes in the two end plates allows the construction of each storage rack unit without the use of ancillary fasteners. Several such storage rack units can be joined together to form a composite storage rack system.

9 Claims, 7 Drawing Sheets

(56) References Cited

U.S. PATENT DOCUMENTS

| | | | | | |
|---|---|---|---|---|---|
| 5,101,738 | A | * | 4/1992 | Sideris | 108/94 |
| 5,169,009 | A | | 12/1992 | Bomze | |
| D346,290 | S | | 4/1994 | Cifra | |
| 5,343,816 | A | | 9/1994 | Sideris | |
| 5,480,026 | A | * | 1/1996 | Darling et al. | 206/315.9 |
| 5,553,707 | A | * | 9/1996 | Lion | 206/315.9 |
| D380,112 | S | * | 6/1997 | Peters | D6/510 |
| 5,772,055 | A | * | 6/1998 | Orr et al. | 211/186 |
| 5,992,647 | A | | 11/1999 | Malik | |
| 6,029,584 | A | | 2/2000 | Cochrane et al. | |
| 6,257,427 | B1 | * | 7/2001 | Schneid | 211/189 |
| D450,199 | S | * | 11/2001 | White | D6/407 |
| 6,374,755 | B1 | * | 4/2002 | Haase et al. | 108/101 |
| 6,401,947 | B1 | * | 6/2002 | Hu et al. | 211/189 |
| 6,644,484 | B1 | * | 11/2003 | Sardis | 211/190 |
| 6,776,298 | B2 | * | 8/2004 | Courtwright | 211/191 |
| D497,763 | S | * | 11/2004 | Kwok | D6/630 |
| 6,817,478 | B2 | * | 11/2004 | Venegas, Jr. | 211/189 |
| 6,830,159 | B2 | * | 12/2004 | Caldwell et al. | 220/345.1 |
| 6,951,374 | B2 | * | 10/2005 | Swenson | 312/285 |
| 6,991,306 | B2 | * | 1/2006 | Swenson et al. | 312/305 |
| D653,052 | S | * | 1/2012 | Finney | D6/461 |
| 8,752,716 | B2 | * | 6/2014 | Gibson et al. | 211/41.14 |
| 8,789,577 | B2 | * | 7/2014 | Caldwell | 160/350 |
| D713,180 | S | * | 9/2014 | Johnston | D6/675.2 |
| D718,557 | S | * | 12/2014 | Johnston | D6/675.5 |
| 2001/0035386 | A1 | * | 11/2001 | Mancini et al. | 211/189 |

* cited by examiner

MODULAR STORAGE RACK SYSTEM

CROSS-REFERENCE TO RELATED APPLICATIONS

This application claims priority to U.S. Provisional Patent Application No. 61/804,466, filed Mar. 22, 2013, the disclosures of which are expressly incorporated herein by reference.

FIELD OF THE INVENTION

The present invention is directed generally to a modular storage rack system. More specifically, the subject invention is directed to a modular storage rack unit which can be assembled, in combination with other modular storage rack units, to form a number of modular storage rack systems. Most specifically, each modular storage rack unit in accordance with the subject invention utilizes spaced end plates that are joined together by dowels and at least one stabilizer panel, without the use of additional fasteners. The modular storage rack unit, in accordance with the present invention, uses a plurality of dowels to connect the two end plates, which are spaced from each other by the lengths of the dowels and of the stabilized panel. Dowel receiving holes are provided in each of the two spaced end plates and are aligned generally with each other. Axes of the holes in a top end plate are offset from the plane of the top plate at a first angle. Axes of the holes in a bottom end plate are offset from the plane of the bottom end plate at a second angle, which is different from the first angle. The separate angular offsets of the end plate holes, together with the provision of the at least one stabilizer panel, allows a modular storage rack unit to be assembled without the use of any ancillary fastness. A plurality of the individual modular storage rack units can be assembled, in a variety of configurations, to construct a wide range of modular storage rack systems.

BACKGROUND OF THE INVENTION

Storage of flat panels, such as artist's works, including paintings, prints and canvasses, has been accomplished by either standing the panels separately on edge or by the use of some type of rack or slotted storage device. Clearly, the storage of a plurality of flat panels, such as paintings, by merely standing each one of the panels on its edge and by leaning each such panel against a wall surface or other vertical support, is very space inefficient. However, since such flat panels, particularly if they have been painted or freshly printed, need to be separated from each other to prevent smearing of the fresh print or paint, they need to be supported out of contact with other such flat panels.

A variety of storage racks and other similar structures have been developed to facilitate the storage of flat panels, such as artists' works, including paintings, prints canvasses and the like. These typically take the form of a pair of spaced, typically horizontal end plates or panels that are joined by a plurality of vertical dividing panels. Such racks can be used to support and to separate a plurality of such artists' works, out of contact with each other. If desired, these prior rack assemblies can be reoriented so that the end plates are vertical and the dividing panels are horizontal. Now the flat panels can be stored in a generally horizontal configuration, again out of contact with each other. Other flat panels, other than artists' works, such as glass panes, mirrors, embroidered panels and the like have also been stored using such rack assemblies.

In many instances, the storage racks do not need to bear a great deal of weight. They are thus often assembled from inexpensive materials, including wooden or similar end plates and a plurality of dowels or rods that define the individual support panels. Such rack assemblies are often provided in a disassembled configuration to save space during shipping and at the point of sale. Such a rack assembly thus needs to be assembled, typically by the consumer, prior to its being usable for its intended purpose. Such assembly has required the use of a variety of fastener elements, such as nails, screws, pins, glue or the like. Each of these fastening devices has added to the difficulty experienced by the ultimate consumer in his or her assembly of the rack assembly. Each of the assembly tasks, such as driving nails, tightening screws, applying glue and other typical fastening installations has added to the complexity of the assembly process of what is typically a utilitarian rack assembly.

Prior rack assemblies have been single purpose devices. Each such rack typically stands alone and has been used solely as a storage rack for the flat panels which are to be stored. If more storage is required, additional rack assemblies can be assembled. There has not been, in the past, a system wherein several individual storage racks could be each assembled and then connected to each other to form a compound storage rack system which could, in turn, be configured as part of a larger structure, such as, for example, a desk or a work bench.

It will thus be seen that a need exists for a modular storage rack unit and system which overcomes the deficiencies of the prior art. The modular storage rack system, in accordance with the present invention, provides such a storage rack unit and system which overcomes the limitations of the prior art.

SUMMARY OF THE INVENTION

It is an object of the present invention to provide a modular storage rack system.

Another object of the present invention to provide a modular storage rack unit which does not require additional fastening devices for its assembly.

A further object of the present invention is to provide a modular storage rack unit which is usable, in combination with other modular storage rack units, to form utilitarian structure, such as compound storage racks, desks, work benches and other pieces of furniture.

Still another object of the invention is to provide a modular storage rack unit which can be shipped and sold as a compact package.

Even yet a further object of the present invention is to provide a modular storage rack unit having spaced dowel end receiving end plates, each with dowel end receiving holes that are inclined at selected angles, with respect to the plane of each of the respective end plates.

As will be discussed in greater detail subsequently, a modular storage rack unit in accordance with the present invention includes spaced end plates, each of which is generally planar and each of which has a plurality of spaced and generally aligned dowel end receiving holes or bores. Axes of the bores or holes in one or the end plates are offset at a first angle from a line which is perpendicular to the plane of the one of the end plates. Axes of the bores or holes in the second end plate are offset at a second angle from a line which is perpendicular to the plane of the second end plate. The first and second angles of offset of the respective bores or holes are different from each other in at least one of degree and orientation. At least one slotted stabilizer panel is positionable between the two end plates. A plurality of dowels or other similar flexible elements are installed with the spaced ends of each such dowel or the like being positioned in the aligned holes in the ones of the two spaced end plates. The provision of the generally slight angle of inclination of each axis of each hole or bore in each of the two spaced end plates, subjects the associated dowel or other somewhat flexible element to an amount of tension sufficient to hold its ends in the holes in the two spaced end plates, thereby eliminating the need for the use of any additional fasteners, such as screws, nails, pins, glue or the like. The presence of the intermediate, slotted stabilizer panel, which also extends between the two end plates, and which has a keying connection between the two end plates, keeps the two end plates parallel to each other. The result is a modular storage rack unit that can be easily and quickly assembled, without the use of additional fastening members, to form a stable storage rack unit which is usable with the two end plates arranged either horizontally or vertically. The resultant spaces between the dowels can thus be oriented either vertically or horizontally. In that way, a plurality of flat plates, such as paintings, prints, glass sheets, wood panels and the like can be easily stored in an out-of-contact manner and with ease of access.

More than one of the modular storage rack units can be assembled together to form a compound modular storage rack system. In its least complex application, two such storage rack units can be joined together by the use of connection bars. The resultant structure with its individual storage stalls aligned, can be used to store and support longer or larger flat plates that would not be sufficiently supported by a single modular storage rack unit. Various ones of the modular storage rack units can be joined to each other to form more complex compound structures, such as desks, work benches and the like. Each such structure still relies on the inherent strength and ease of assembly of its individual modular storage rack units.

Each modular storage rack unit in accordance with the present invention utilizes a tension imparted to the flexible dowels or other similar connecting pieces, extending between the two spaced end plates, to hold the structure together without the use of any additional fasteners. The slight angular offsets in the dowel end receiving holes in the two spaced end plates, and the differences in the directions of the angles from one plate to the other, are sufficient to impart the requisite tension to each dowel and to thus hold the two plates in place, without the need for additional fasteners. The at least one additional stabilizer panel has a keying connection to both of the end plates and serves to maintain the end plates parallel to each other and to keep the individual modular storage rack units each in their proper shape, such as square or rectangular.

It will be evident to one of ordinary skill in the art that the modular storage rack system in accordance with the present invention overcomes the limitations of the prior art. As such, it is a substantial advance over that prior art.

BRIEF DESCRIPTION OF THE DRAWINGS

A full and complete understanding of the modular storage rack system in accordance with the present invention may be had by referring to the Detailed Description of the Preferred Embodiments, as set forth subsequently, and as may be seen in the accompanying drawings, in which.

DESCRIPTION OF THE PREFERRED EMBODIMENT

Figure 1:
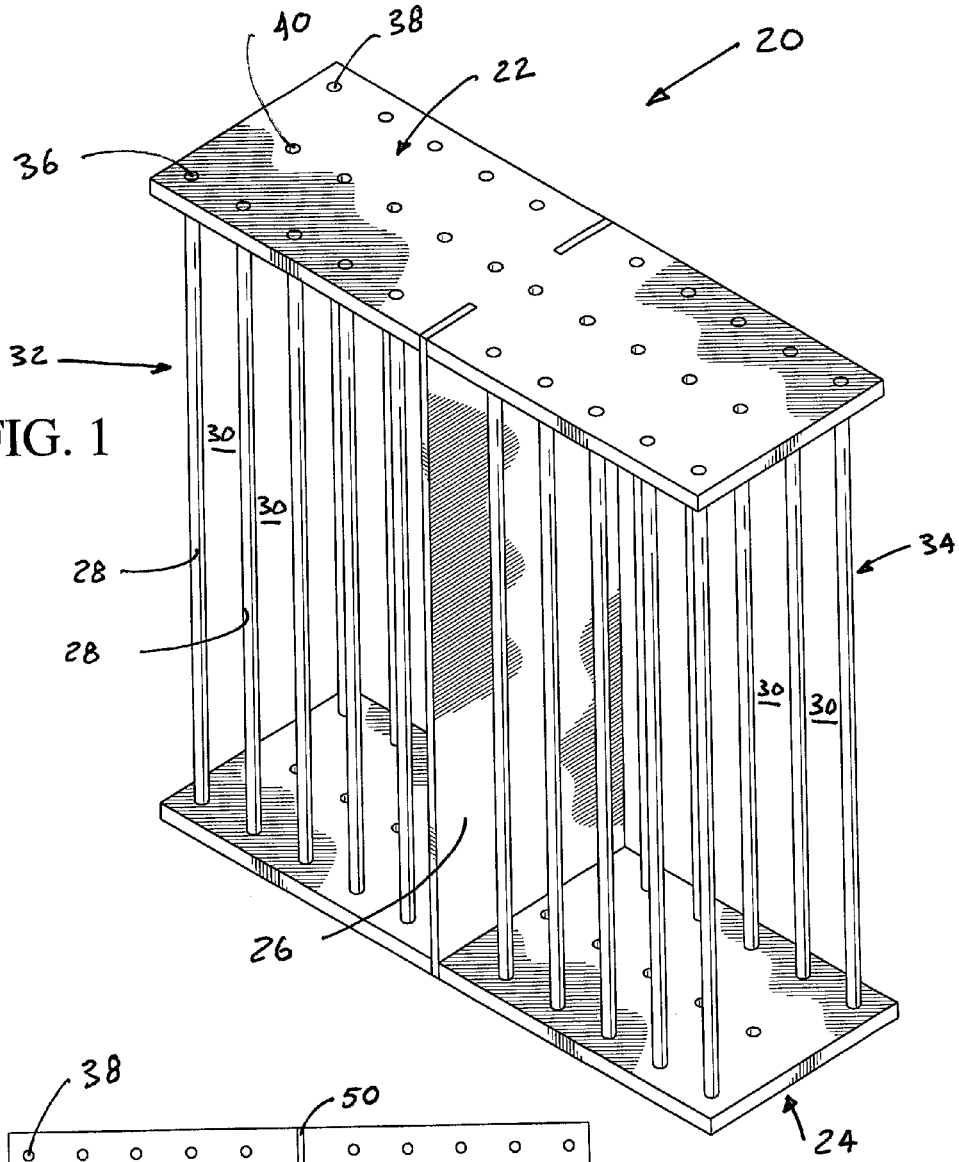
FIG. 1 is a perspective view of a first preferred embodiment of a modular storage rack unit in accordance with the present invention.
Figure 2:
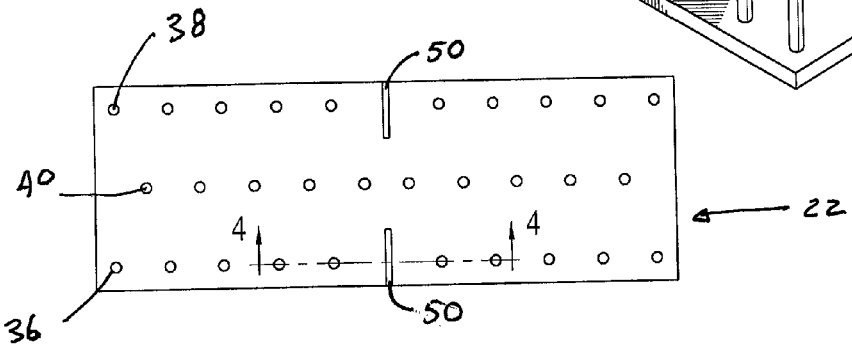
FIG. 2 is a top plan view of the storage rack of FIG. 1.

Referring initially to FIG. 1, there may be seen a perspective view, generally at 20, of a first preferred embodiment of a modular storage rack unit in accordance with the present invention. The modular storage rack unit 20 is comprised generally of a first or top end plate 22, a second or bottom end plate 24, an intermediate stabilizer panel 26 and a plurality of dowels 28, each of which extends between the first or top end plate 22 and the second or bottom end plate 24. It will be understood that in the first preferred embodiment which is depicted in FIG. 1, the two end plates 22 and 24, the stabilizer panel 26 and the plurality of dowels 28 are all made of wood. While wood is the preferred structural material for use in making the modular storage rack unit in accordance with the present invention, it is not the only material which could be used. Other materials such as suitable plastic compositions could also be used so long as the dowels display a suitable amount of flexibility, as will be discussed subsequently. In a preferred embodiment of the modular storage rack unit, generally at 20, each end plate 22, 24 can be made of ½ inch thick wood with the two end plates 22, 24 being spaced apart by generally about 16 inches. Each end plate is 4 inches in width and 16 inches in length. The dowels are each 5/16 of an inch in diameter. It will be understood that these dimensions are exemplary of one embodiment and that these dimensions can be varied, depending on the overall sizes of the desired resultant modular storage rack unit and the weight of the articles such a storage rack unit will be expected to support. It will be understood that the actual size of each modular storage rack unit is a function of the size or sizes of the article or articles which are intended to be stored. It will be further understood that the end plates can be of various shapes, such as rectangular, square, circular, ovoid and the like. In the discussion that follows, the two end plates 22 and 24 may be referred to as top and bottom plates, respectively. It will be understood that this reference is mainly for the sake of convenience and that the modular storage rack unit, generally at 20, could easily be rotated by 90° so that the end plates 22 and 24 would be oriented vertically and the dowels 28 would be arranged horizontally.

In the orientation of the modular storage rack unit 20 depicted in FIG. 1, the plurality of dowels 28 are aligned to define a plurality of spaced storage stalls, or slots or storage openings, each generally at 30. These stalls, or slots or storage openings 30 are each defined by a space adjacent ones of the dowels 28 in each of a first or front dowel row 32 and a second or rear dowel row 34. Again, the use of the terms front and rear is for the sake of convenience only. In each of the two rows of dowels 32 and 34, as depicted in FIG. 1, the spacing between adjacent ones of the dowels in each of the rows has been selected or determined as a function of the overall size of the individual modular storage rack unit 20 and of the weight of the objects which it will be used to support.

Figure 7:
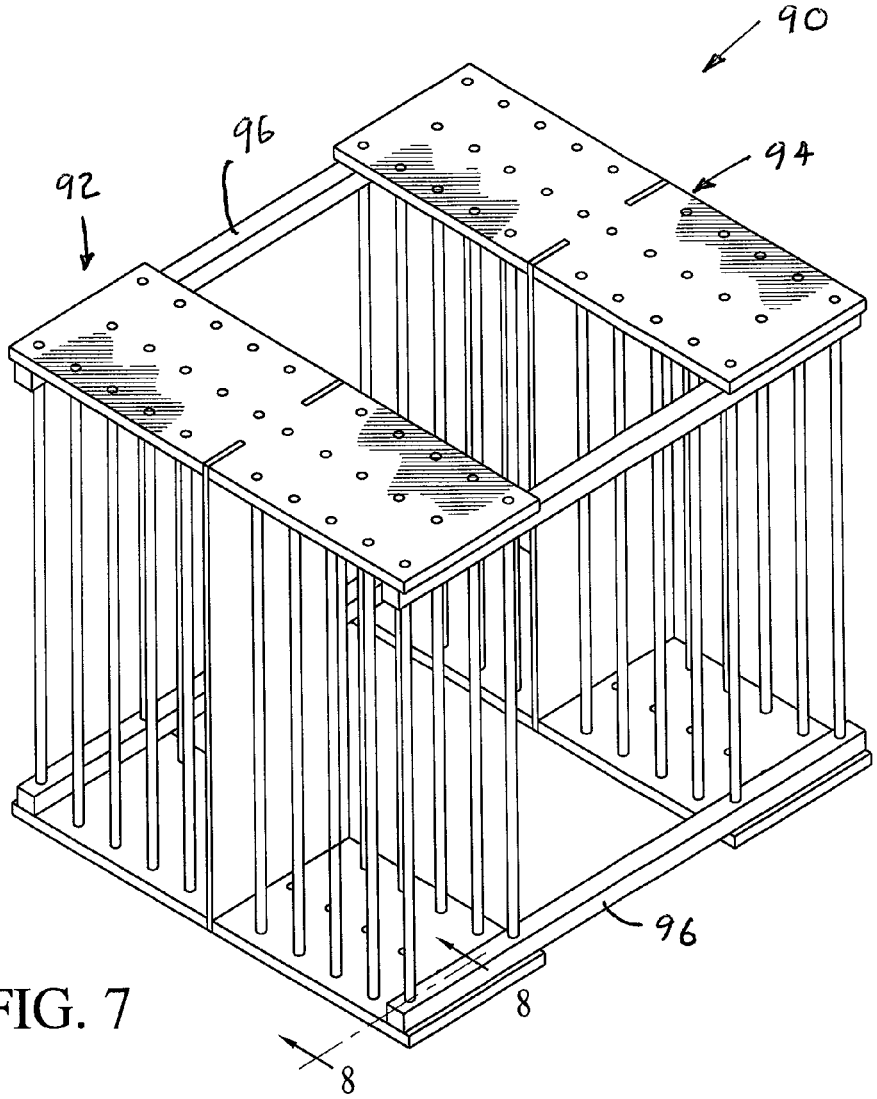
FIG. 7 is a perspective view of a first embodiment of a composite storage rack system in accordance with the present invention.

While not depicted in FIG. 1, it will be understood that, in the orientation of the modular storage rack unit 20 depicted in FIG. 1, various flat panels, such as artists paintings, blank canvasses, printed articles and the like can be inserted into each of the stalls or storage openings 30, typically in alignment with cooperating front and rear ones of the spaced dowels 28. If the flat plates or panels which are to be supported are substantially larger than the width of a single modular storage rack unit, as will be discussed later, and as is depicted in FIG. 7, for example, a pair of modular storage rack units 20 can be joined together to form a compound storage rack system.

Several groups of holes, such as front holes 36, rear holes 38 and intermediate holes 40 are formed in rows in each of the top and bottom plates 22 and 24 respectively. In the configuration of the subject invention, as depicted in FIG. 1, the front and rear holes 36 and 38 are aligned with each other while the intermediate holes 40 are offset along the length of each of the plates 22 and 24, with reference to the individual holes 36 and 38 in the front and rear rows of holes. This configuration can also be varied so that all of the rows of holes 36, 38 and 40 could be aligned with each other in the front to back direction of each such modular storage rack unit 20. As will also be discussed subsequently, the specific orientations of the front, rear and intermediate rows of holes 36, 38 and 40 is also a function of the use to which the individual storage rack unit will be subjected.

Figure 3:
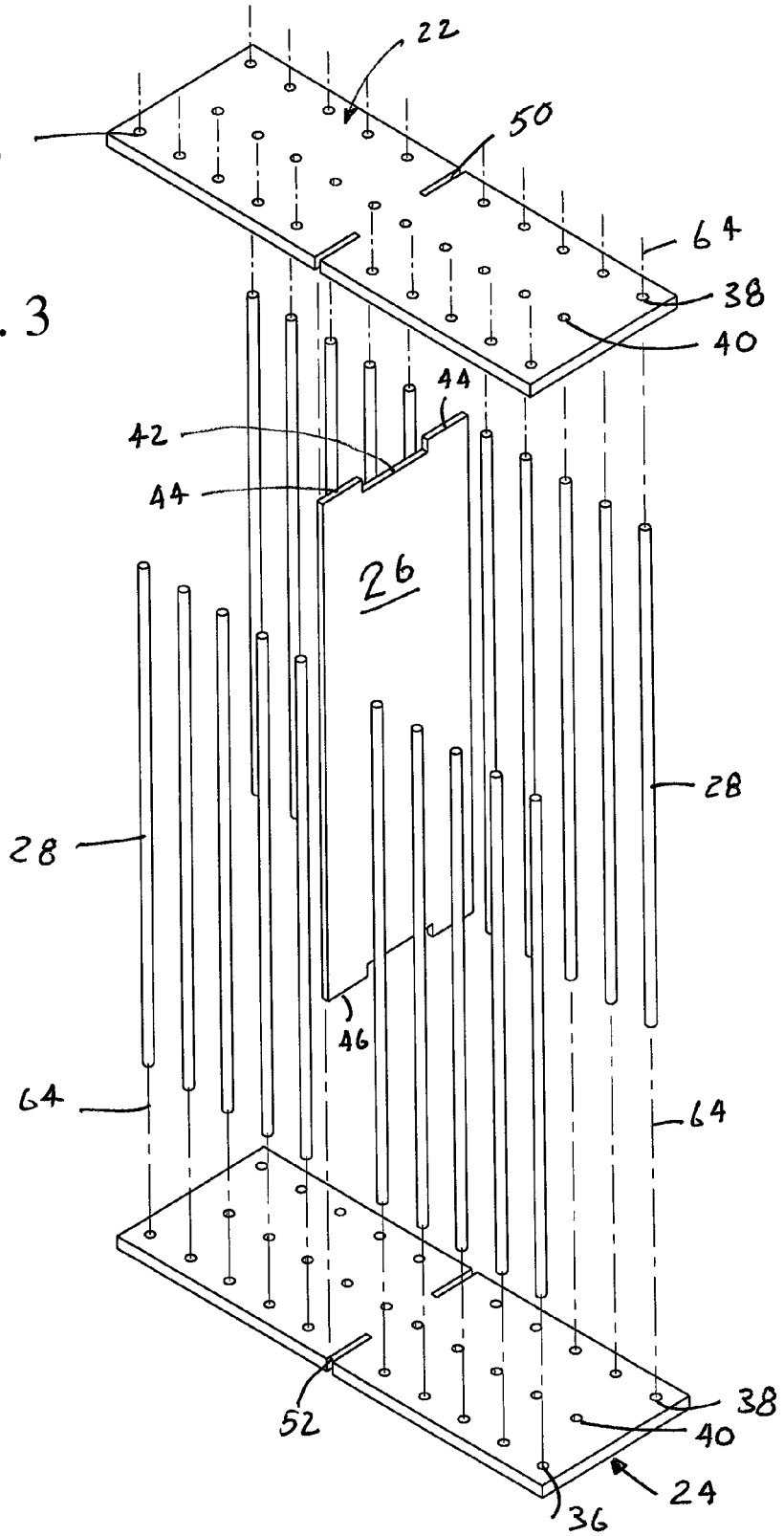
FIG. 3 is an exploded perspective view of the modular storage rack unit of FIG. 1.

As depicted most clearly in the exploded perspective view of FIG. 3, the stabilizer panel, generally at 26, is generally rectangular in overall shape. It is preferably also made of wood, and in the embodiment depicted in FIG. 1, has a thickness of ¼ inch. An upper end 42 of the stabilizer panel 26 is configured with two spaced apart upper tabs 44. Similar spaced lower tabs 46 are formed on a bottom or lower end 48 of the stabilizer panel 26.

The first or top end plate 22 is formed with a pair of top end plate slots 50 generally midway along its length while the second or lower end plate 24 is provided with cooperating bottom end plate slots 52, all as seen most clearly in FIG. 3. Each of these slots 50, 52 is dimensioned to receive a cooperating one of the stabilizer panel tabs 44 46, when the modular storage rack unit, generally at 20 is assembled. It will be understood that, in the preferred embodiment depicted in FIG. 1, the extensions of the tabs 44, 46 from their respective ends 42, 48 of the stabilizer panel will each be generally ½ inch so that the free ends of the tabs will be coincident with an outer surface of each end plate 22, 24. If the width of each such end plate is generally 4 inches, the length of each of the slots 50, 52 may be in the range of 1 inch. The tabs 44, 46 and the slots 50, 52 ensure that the stabilizer panel, generally at 26, is locked in place in the two end plates 22, 24 to form the modular storage rack unit in accordance with the present invention as assembled.

As may be seen in FIG. 3, the modular storage rack unit, generally at 20, in accordance with the present invention is assembled totally without the use of any fastening means such as nails, screws, pins, glue or the like. The stabilizer panel 26 is placed between the first end panel 22 and the second end panel 24 with its tabs 44, 46 in the respective slots 50, 52 of the panels 22, 24. A plurality of the dowels 28 are then slid into aligned ones of the holes 36, 38 and/or 40 in both of the first and second or top and bottom end plates 22, 24. While the diameter of the dowels 28 and the diameter of each of the holes 36, 38 and 40 are essentially the same, to thus ensure a snug, interference fit of each dowel end into the respective hole, that is not the only reason the resultant modular storage rack unit does not require any further fasteners to hold it together.

Figure 4:
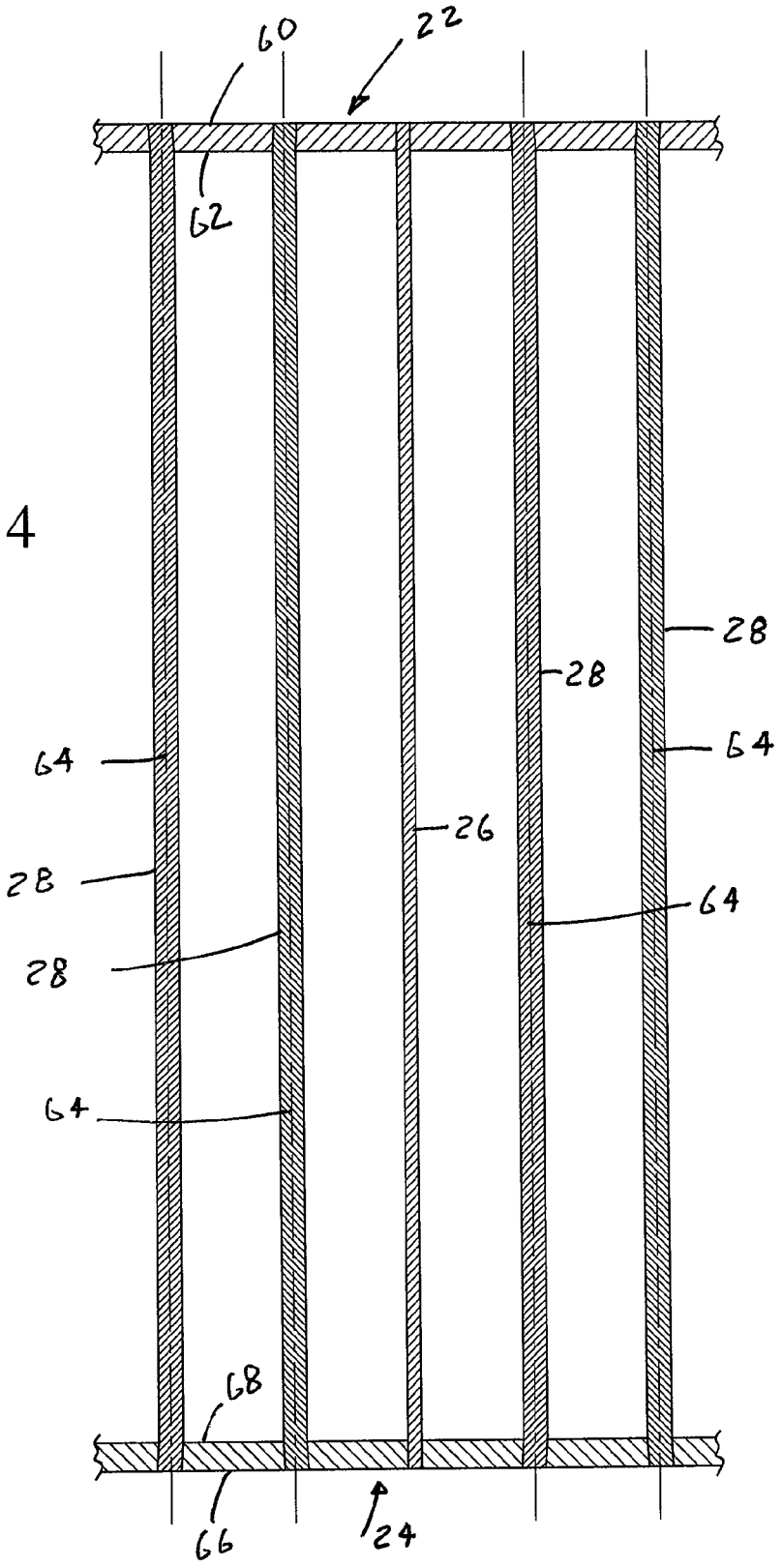
FIG. 4 is a cross-sectional view taken along line 4-4 of FIG. 1.
Figure 5:
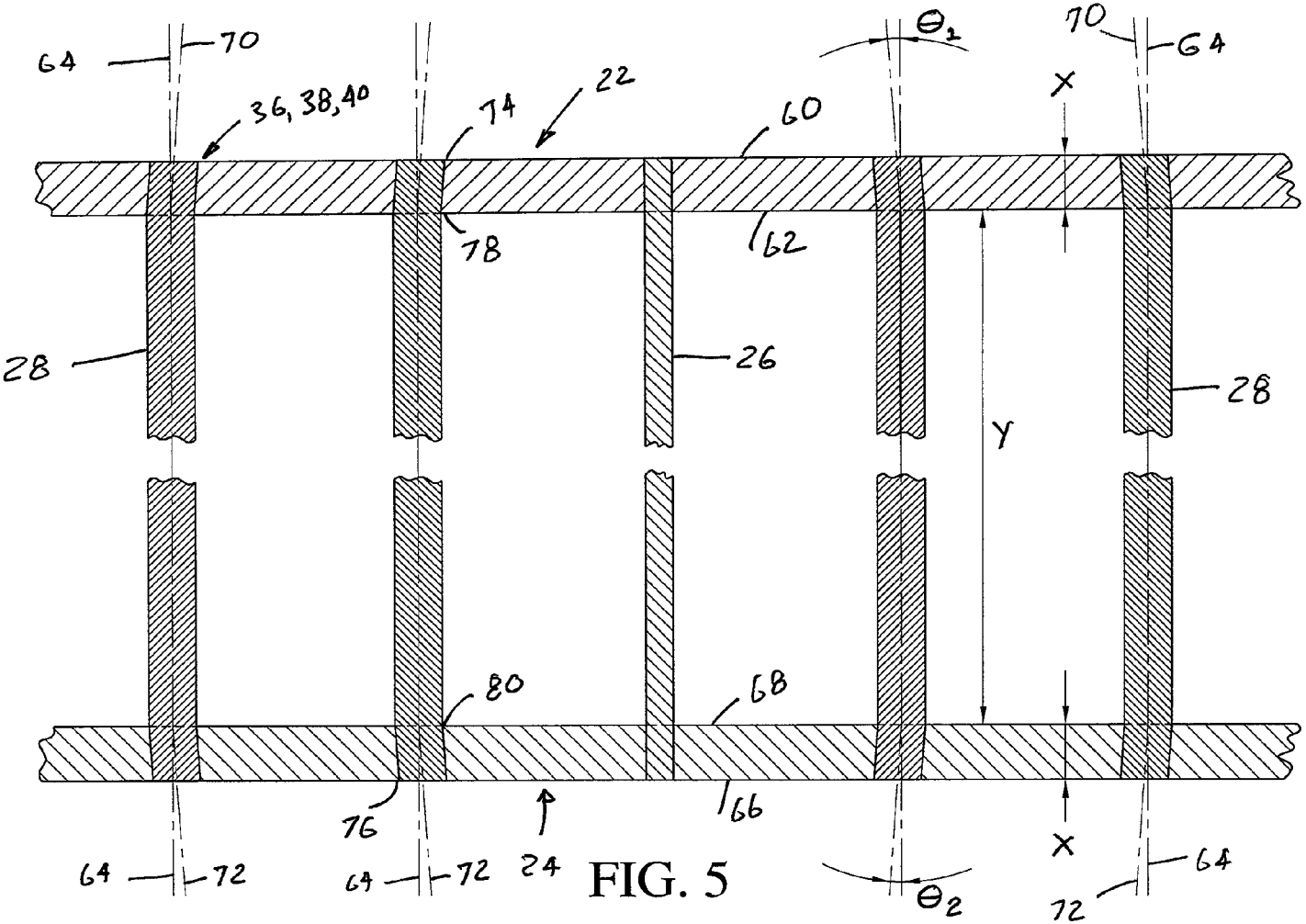
FIG. 5 is an enlarged view of a portion of FIG. 4.
Figure 6:
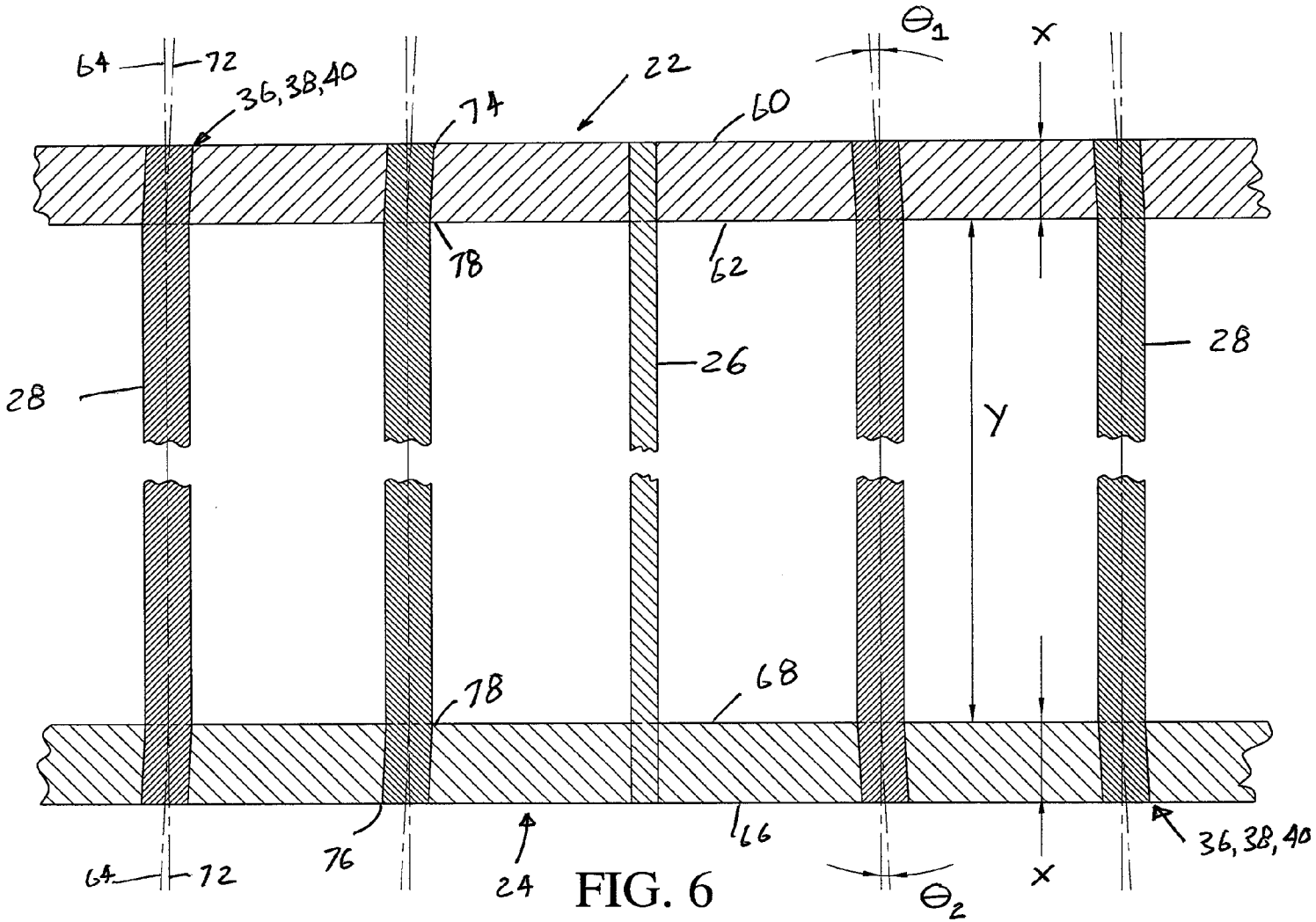
FIG. 6 is a view similar to FIG. 5.

In accordance with the present invention, and as depicted in FIGS. 4-6, each one of the holes 36, 38 and 40 has a longitudinal axis which is inclined at a slight angle with respect to a vertical line that is perpendicular to a plane of its associated end plate 22, 24. The angle or angles of inclination of the holes in the top plate 22 are not the same as the angle or angles of inclination of the holes in the bottom plate 24. Still further, angles of inclination of adjacent ones of the holes 36, 38, 40 in the top plate can be different from each other. Further, angles of inclination of holes in the top plate 22 may not be complementary to the angles of inclination of holes in the bottom plate 24. It is this diverse arrangement of angles of inclination which place the individual dowels in sufficient tension so that they each are securely held in the plate holes to thereby form a rigid, stable modular storage rack unit.

As may be seen generally in FIG. 4, the top or first end panel, generally at 22, has an outer surface 60 and an inner surface 62. These two surfaces are parallel to each other and each define a surface plane. The individual dowels 28 each have a longitudinal dowel axis 64. The bottom or second end plate 24 also has an outer surface 66 and an inner surface 68, both of which are planar and are parallel to each other. When assembled, the planes of the first and second end plates 22 and 24 are parallel to each other.

Referring now to FIG. 5, each of the individual holes 36, 38 and 40 in the upper end plate 22 has an upper plate hole longitudinal axis 70 which is angled, with respect to the longitudinal dowel axis 64 by a first angle $\theta_1$. The individual holes 36, 38 and 40 in the lower end plate 24 each have a lower plate hole longitudinal axis 72 which is angled, with respect to the longitudinal dowel axis 64 by a second angle $\theta_2$. The individual hole angles of inclinations $\theta_1$ of the first or top end plate 22 are not the same as the angles of inclination $\theta_2$ of the holes in the lower or second end plate 24. As a result, the outer terminus 74 of each upper hole 36, 38, 40 in the upper or first end plate 22 is not typically axially aligned along the axis 64 of each dowel with the outer terminus 76 of each lower hole 36, 38, 40 in the lower or second end plate 24. The inner terminus 78 of each hole 36, 38, 40 in the first or upper end plate 22 is aligned along the axis 64 of each dowel 28, with an inner terminus 80 of each of the holes 36, 38, 40 in the second or lower end plate 24.

In the embodiment depicted in FIG. 5, for example, where the thickness "x" of each of the first or top end plates 22 and of the second or bottom end plates 24 may be ½ inch, and the spacing between the two plates, identified at "y", may be 16 inches, the angles $\theta_1$ *and* $\theta_2$ may each be generally in the range of 2° to 6° and are preferably each approximately 4°. If, for example, the thickness "x" of each end plate 22, 24 is ¾ of an inch and the spacing distance "y" is again 16 inches, each angle $\theta_1$; $\theta_2$ may be between 2° and 5° and preferably is about 3°. The angles $\theta_1$ *and* $\theta_2$ are a function of the thickness of the top and bottom end plates 22 and 24 and also of the density of the wood which is the preferred material used in the construction of the storage rack units. For example, a soft, less dense wood, such as poplar may use a 4° angle to secure and hold the ends of each dowel. A denser wood, such as mahogany may require only a 2-3° angle to accomplish the same result. It will be understood that while each of the respective angles $\theta_1$ *and* $\theta_2$ may have the same angular degree amount, their directions of inclination are not the same from the top plate 22 to the bottom plate 24. In other words, as depicted in FIG. 5, the angle $\theta_1$ in the top plate 22 is angled at 4° to the left of vertical in the upper quadrant, wherein the lower angle $\theta_2$ is angled at 4° to the right of vertical in the same upper quadrant.

In FIG. 5, the angles $\theta_1$ *and* $\theta_2$ are essentially mirror images of each other. In contrast, in FIG. 6, the angles $\theta_1$ *and* $\theta_2$ are essentially parallel to each other. If the axes of the holes in the upper plate and the lower plate were extended, the resultant lines, as depicted in FIG. 6, would be parallel. However, the two individual angles $\theta_1$ *and* $\theta_2$ are still different from each other with respect to the outer plane of their respective end plates. In the upper end plate 22, the angle $\theta_1$ is inclined at 4° to the left, with respect to a vertical line which is perpendicular to the plane of the outer surface 60, wherein the angle $\theta_2$ is inclined at 4° to the right of a vertical line which is perpendicular to the plane of the outer surface 66 of the lower plate.

The above discussion has been essentially two dimensional; i.e. in conventional x and y axes of a typical two dimensional coordinate system when discussing the relative angles $\theta_1$ *and* $\theta_2$. It is also possible to orient these two angles of inclination $\theta_1$ *and* $\theta_2$ in a three-dimensional coordinate system; i.e. one using x, y and z axes. The angles of the holes in the top or first end plate 22 are again different from the angles of the holes in the bottom or second end plate 24, possibly both in the x-y direction and also in the y-z direction. It is this difference in the angles $\theta_1$ *and* $\theta_2$ which places the dowels under sufficient bending stress or tension to securely hold the dowel ends in the respective end plates and to facilitate the secure assembly of each modular storage rack unit without the need for supplementary fasteners of any type.

Turning now to FIG. 7, there may be seen a composite modular storage rack system in accordance with the present invention, generally at 90. This storage rack system is the result of the joining together of a first storage rack unit 92 and a second storage rack unit 94. In the configuration of the composite storage rack system depicted in FIG. 7, the two individual storage rack units 92 and 94 are each the same and are each structured essentially the same as the first preferred embodiment 20 of the storage rack unit previously discussed and depicted in FIGS. 1-6.

Figure 8:
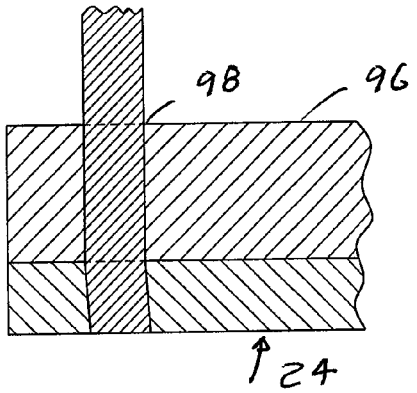
FIG. 8 is a cross-sectional view taken along line 8-8 of FIG. 7.

The two storage rack units 92 and 94 are joined together by the use of four parallel connection bars, each at 96. In the embodiment depicted in FIGS. 7 and 8, each of these connection bars 96 is a 1 inch by 1 inch member whose length is determined by the desired resultant spacing between the two individual storage rack units 92 and 94. As may be seen most clearly in FIG. 8, each such connection bar 96 has several through bores 98 which are located in alignment with individual ones of the holes 36, 38 and/or 40 in each of the end plates 22 and 24 of each storage rack unit 92, 94. These connection bar through bores 98 are not angled or inclined with respect to the axes of the various dowels 28. In other words, the longitudinal axes of the connection bar through bores 28 are perpendicular to the planes of the inner surfaces of the end plates 28, not at an angle to that perpendicular, as are the angles $\theta_1$ *and* $\theta_2$ of the holes 36, 38 and 40.

The connection bars 96 are positioned so that they are in contact with the inner surfaces 62 and 68 of the first and second end plates 22 and 24 respectively. They extend parallel to the width direction of each of the end plates. In the assembly of each of the storage rack units 90 or 92, the connection bars 96 are placed on the inner surfaces 62, 68 of the respective end plates 22 and 24 before the plurality of dowels 28, or at least those dowels 28 which will pass through to the connection bar through bores 98, are inserted.

The composite storage rack system, depicted generally at 90 in FIG. 7, has a plurality of storage slots or stalls whose overall lengths are much greater than those which are provided by a single storage rack unit 20. The first storage rack unit 92 can receive first ends of artists' canvasses, printed plates, mirrors, glass sheets, wood panels or any other similar planar object. The second storage rack unit 94 will support the second end of the planar object inserted into each such stall. In the orientation of the composite storage rack system 90 depicted in FIG. 7, the individual panels or flat plates to be supported can be inserted from either unit's outer side. The composite storage rack system 90 depicted in FIG. 7 is oriented with the upper and lower end plates 22 and 24 generally horizontal. This results in a plurality of plate or panel storage slots or stalls in which each plate or panel is supported along a longitudinal bottom edge. If desired, the composite storage rack system 90 could be rotated 90° either to the right or left, as seen in FIG. 7 or to the front or rear, again as seen in FIG. 7. This would change the orientation of the individual panel or plate storage slots or stalls. If the composite storage rack system 90 were rotated 90° to the left or right, as seen in FIG. 7, the individual dowels 28 would be horizontal and stored plates or panels could be supported by the underlying dowels in each such storage space or stall. If the composite storage rack system 90 of FIG. 7 were to be rotated 90° forwardly or rearwardly, as seen in FIG. 7, the storage stalls or slots would be oriented to receive panels or plates inserted vertically from the top. If desired, dowels could be placed in the intermediate row holes 40 of what would now be the lower unit 94, assuming a 90° rearward rotation. These intermediate dowels 28 could act as stops to limit the insertion of the supported panels or plates into each such receiving stall or slot.

Figure 9:
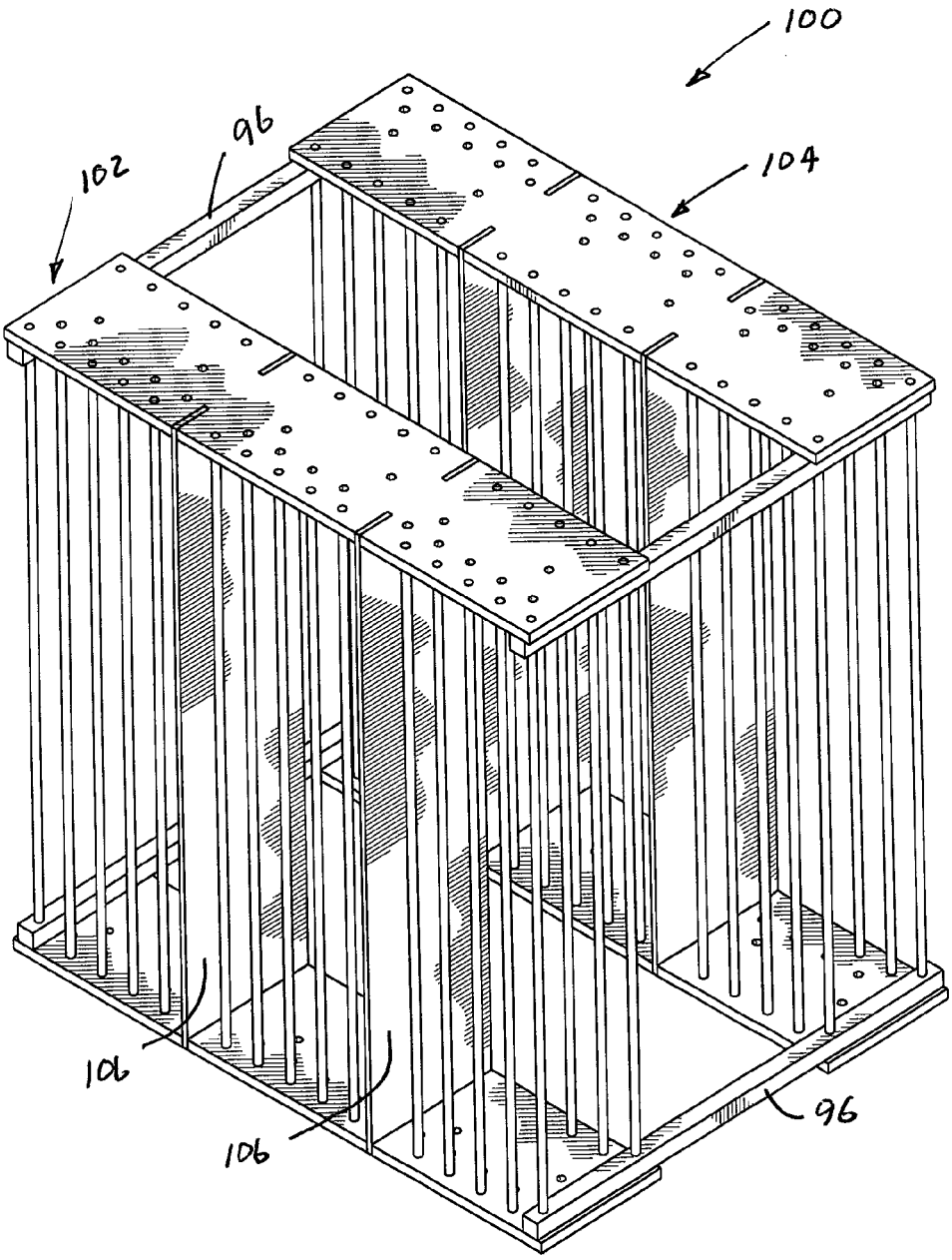
FIG. 9 is a perspective view of a second preferred embodiment of a composite storage rack system in accordance with the present invention.

FIG. 9 depicts a second composite storage rack system, generally at 100 in accordance with the present invention. As was the case with the first embodiment of the composite storage rack system 90, in this second embodiment, there are provided a first storage rack unit 102 and a second storage rack unit 104. In contrast to the embodiment depicted in FIG. 7, in this second embodiment 100, each of the storage rack units 102 and 104 has two spaced stabilizer panels 106. In this embodiment, the overall size of each storage rack unit 102, 104 is larger than each individual storage rack unit 92, 94 depicted in FIG. 7. The structure for joining the two units 102 and 104 is the same as was discussed in connection with the system 90 depicted in FIG. 7.

It will be understood that the overall size of each storage rack unit is variable, depending on the size of the prints, panels or plates which are to be supported. It will also be understood that the two composite storage rack systems 90 and 100 depicted in FIGS. 7 and 9 are examples of a wide variety of composite storage rack systems of different sizes and shapes which can be constructed using individual storage rack units and connector bars. If desired, several such composite storage rack systems could be configured to form a desk or a work bench or a similar object that could receive and support a large number of plates, panels, sheets or other similar objects.

If desired, and referring again to the first preferred embodiment of the storage rack unit, which is depicted generally at 20 in FIG. 1, alternating ones of the dowels in the front holes 36 or in the rear holes 38 could be removed. The result would be storage slots or stalls 30 that would be able to receive, for example, wine bottles standing vertically in the rack which is depicted in FIG. 1, or arranged on their sides, if the rack unit 20 depicted in FIG. 1 were to be rotated 90° to the left or right, so that the dowels would be horizontal and the bodies of the bottles of wine could be supported on, or cradled between front and rear dowels below the now removed front or rear dowel. Other possible uses of the modular storage rack unit and the composite storage rack system in accordance with the present invention are left to the imagination and creativity of the ultimate user.

While preferred embodiments of a modular storage rack system in accordance with the present invention have been set forth fully and completely hereinabove, it will be apparent to one of skill in the art that various changes in, for example, the overall dimensions of each rack, the materials used in the fabrication of each rack, the assemblage of individual racks to form a composite storage rack system and the like, could be made without departing from the true spirit and scope of the present invention. Accordingly, the subject invention is to be limited only by the scope of the appended claims.

What is claimed is:

1. A storage rack unit for storing items comprising:

a first end plate having a first plane;

a second end plate having a second plane parallel to the first plane and spaced from the first end plate;

a stabilizer panel extending between the first end plate and the second end plate and being generally perpendicular to the first and second end plate planes;

a plurality of first plate holes in the first end plate with each such first end plate hole having a first hole longitudinal axis inclined at a first angle to a first line perpendicular to said first plate;

a plurality of second plate holes in the second end plate, with each such second end plate hole having a second hole longitudinal axis inclined at a second angle to a second line perpendicular to said plane of said second end plate, said first angle being different from said second angle; and a plurality of flexible dowels extending between and connecting said first and second end plates with first dowel ends being inserted in individual ones of said first end plate holes and with second dowel ends being inserted into individual ones of said second end plate holes;

wherein items are adapted to be stored between corresponding pairs of adjacent dowels.

2. The storage rack unit of claim 1 wherein said stabilizer panel has tabs at ends of said panel adjacent said first and second end plates.

3. The storage rack unit of claim 2 further including slots in said first and second end plates, said slots each being positioned and dimensioned to receive one of said stabilizer panel tabs.

4. The storage rack unit of claim 1 wherein each of said first and second end plates is a rectangular plate.

5. The storage rack unit of claim 4 wherein said plurality of first end plate holes and said plurality of second end plate holes include front, rear and intermediate rows of said end plate holes.

6. The storage rack unit of claim 1 wherein said first end plate holes are aligned with said second end plate holes.

7. The storage rack unit of claim 1 wherein said end plates, stabilizer panel and dowels are wood.

8. The storage rack unit of claim 1 including at least one additional storage rack unit connected to said storage rack unit to form a composite storage rack module.

9. The storage rack unit of claim 8 further including a plurality of connector bars connecting said storage rack and said at least one additional storage rack unit.

* * * * *